US006161917A

United States Patent [19]

Igarashi et al.

[11] Patent Number: 6,161,917

[45] Date of Patent: Dec. 19, 2000

[54] INK JET RECORDER

[75] Inventors: Hiroshi Igarashi; Hiroo Ogawa; Makoto Ishii, all of Nagoya; Hiroshi Tokuda, Anjou; Shinji Kimura, Kani; Takashi Nakata, Nisshin, all of Japan

[73] Assignee: Brother Kogyo Kabushiki Kaisha, Nagoya, Japan

[21] Appl. No.: 09/116,663

[22] Filed: Jul. 17, 1998

[30] Foreign Application Priority Data

Jul. 18, 1997 [JP] Japan ..... 9-193747

[51] Int. Cl.[7] ..... B41J 2/165

[52] U.S. Cl. ..... 347/22

[58] Field of Search ..... 347/22, 35, 88, 347/104, 105; 101/216, 218

[56] References Cited

U.S. PATENT DOCUMENTS 4,870,430 9/1989 Daggett et al. ..... 347/88

5,831,644 11/1998 Kato ..... 347/22

5,920,332 7/1999 Brooks ..... 347/85

*Primary Examiner*—Huan Tran

*Attorney, Agent, or Firm*—Oliff & Berridge, PLC

[57] ABSTRACT

An ink jet recorder includes a recording head, a carriage for reciprocating the head, a sheet conveying roller, a motor for driving the roller, a maintenance mechanism and an ink supply mechanism. The driving force from the motor can be transmitted through a first clutch to the maintenance mechanism, and through a second clutch to the ink supply mechanism. One of the clutches is connected to a turn lever, and the other is connected to a shift lever. Each of the clutches can be switched mechanically by the carriage engaging with the associated lever. The single motive power source can drive a plurality of mechanisms. There is no need of a special switch for changing over the source.

24 Claims, 13 Drawing Sheets

INK JET RECORDER

BACKGROUND OF THE INVENTION

1. Field of the Invention

The present invention relates to an ink jet recorder for use with hot melt ink or other ink. In particular, the invention relates to the ink jet recorder in which driving force for conveying a recording medium with respect to a recording head can be transmitted to a recording head maintenance mechanism and an ink supplying mechanism through clutches.

2. Description of Related Art

A conventional ink jet printer for use with hot melt ink includes a recording head unit mounted on a carriage. This unit includes nozzle heads, ink melters and hoppers. The heads each have a number of nozzles. The melters each have a heater. The hoppers can receive ink pellets, which are solid at ordinary temperature. The carriage can reciprocate in the primary scanning directions, perpendicularly to which a sheet of paper or another recording medium can move. While the carriage is moved in the primary scanning directions, hot melt ink droplets are ejected from nozzles of one or more of the heads onto a recording medium.

The printer also includes an ink supply unit positioned at the top of the printer casing near its one side. This unit stores ink pellets. When one of the hoppers of the recording head unit is short of hot melt ink, the carriage is moved to a position adjacent to the ink supply unit. Then, the driver of the supply unit operates to drop one of the stored pellets into this hopper.

The printer further includes a maintenance unit positioned near the other side of the casing. With the carriage positioned near this side, this unit can force hot melt ink to be ejected from the nozzles onto an unwound part of a roll of wiping paper. This prevents the nozzles from clogging during normal print. The unwound part of the paper roll can wipe the nozzle surfaces. It is therefore necessary to take up this part of the roll little by little every time maintenance is carried out.

The printer needs to have a driver for feeding a recording medium to the print area of the printer and discharging a printed recording medium onto the discharge tray of the printer.

Therefore, the printer includes independent motive power sources each for one of the recording medium conveying system, the ink supply unit and the maintenance unit. When the carriage is positioned near each of this system and these units, the associated source operates. The independent sources raise printer production costs.

Japanese Patent Application Laid-Open No.4-302258 corresponding to U.S. Pat. No. 5,226,639 and Japanese Patent Application Laid-Open No. 8-307591 corresponding to U.S. patent application Ser. No. 641,749 filed on May 2, 1996 disclose facsimile machines, which each include a drive mechanism. The mechanism includes a reversible drive motor, from which motive power can be transmitted to a sun gear. An arm can pivot on the axis of the sun gear, and carries a planet gear. The planet gear is in mesh with the sun gear to rotate on its own axis and turn around the sun gear. The angular position of the arm is limited through a solenoid or another actuator, or a cam. The drive mechanism can selectively drive paper feed rollers, paper discharge rollers, a platen, an original reading roller, etc. Separate or special operation of the actuator needs controlling. The phase of the cam needs controlling with another planetary gear drive. In any case, the mechanism is very complicated in structure.

SUMMARY OF THE INVENTION

It is an object of the invention to provide an ink jet recorder in which an ink supply mechanism and a maintenance mechanism can be driven by a common motive power source thereto without any actuators for these mechanisms.

An ink jet recorder according to a first aspect of the invention includes a recording head for ejecting ink toward a recording medium. A recording medium can be conveyed toward the head by a conveying roller. The roller can be driven by a motive power source. The ejection of ink from the head can be kept in good condition by a maintenance mechanism. The driving force from the source can be transmitted through a clutch to the maintenance mechanism. The head can be carried by a carriage perpendicularly to the direction in which a recording medium is conveyed. When the carriage moves toward or away from the maintenance mechanism, the carriage movement is used by a clutch switch to render the clutch operative or inoperative.

The clutch operation can be controlled with the carriage movement. Therefore, there is no need of an actuator for switching the clutch. This can simplify the recorder structure. This also makes it easy to control the clutch. Consequently, the recorder production costs can be low.

The clutch may include a sun gear, a planet arm, a planet gear and a driven gear. The driving force from the motive power source can be transmitted to the sun gear. The arm is supported rotatably an the axis of the sun gear. The planet gear is supported rotatably by the arm and meshes with the sun gear. The driven gear can mesh with the planet gear, and is connected to the maintenance mechanism. When the arm is at a first angular position, the planet gear meshes with the driven gear to transmit the driving force to the maintenance mechanism. When the arm is at a second angular position, the planet gear disengages from the driven gear to transmit no driving force to the maintenance mechanism. In this case, the clutch is advantageous because it is simple in structure and operates securely.

The clutch switch may include a pivot arm for engaging with the planet arm to turn the planet arm. The switch may further include a turn lever for turning the pivot arm. When the carriage moves toward the maintenance mechanism, the carriage turns the lever so that the driving force may be transmitted to the maintenance mechanism through the swinging of the pivot arm and the turning of the planet arm.

The maintenance mechanism may include a roll of paper, a take-up roller and a take-up gear. The recording head can be pressed on the roll. The take-up roller can wind an unwound part of the roll. The take-up gear is fitted to the take-up roller to drive it. The take-up gear meshes with the driven gear of the clutch.

An ink jet recorder according to a second aspect of the invention includes a recording head for ejecting ink toward a recording medium. A recording medium can be conveyed toward the head by a conveying roller. The roller can be driven by a motive power source. The head can be supplied with ink by an ink supply mechanism. The driving force from the source can be transmitted through a clutch to the supply mechanism. The head can be carried by a carriage perpendicularly to the direction in which a recording medium is conveyed. When the carriage moves toward or away from the supply mechanism, the carriage movement is used by a clutch switch to render the clutch operative or inoperative.

The motive power source of this recorder is common to the recording medium conveying roller and the ink supply mechanism. Therefore, there is no need for the recorder to have two motive power sources in it. Consequently, it is possible to simplify the recorder structure, and lower the recorder production costs. The clutch operation can be controlled with the carriage movement. Therefore, there is no need of an actuator for switching the clutch. This can make the recorder structure simpler.

The clutch of this recorder may be simple in structure, and include a driving clutch plate and a driven clutch plate for mutual engagement. The driving plate may include a gear formed on the periphery thereof, to which the driving force can be transmitted.

The clutch switch of this recorder may include a shift rod for forcing the driving clutch plate into engagement with the driven clutch plate. The switch may also include a shift lever connected to the rod. The carriage may include a pusher protruding from its back. When the carriage moves toward the ink supply mechanism, the pusher engages with and moves the shift lever so that the rod engages the driving plate with the driven plate.

The ink supply mechanism may include a cam connected to the driven clutch plate, and a turn lever engaging with the cam. The mechanism may further include a member connected to the turn lever to force out ink.

An ink jet recorder according to a third aspect of the invention includes a recording head for ejecting ink toward a recording medium. A recording medium can be conveyed toward the head by a conveying roller. The roller can be driven by a motive power source. The ejection of ink from the head can be kept in good condition by a maintenance mechanism. The driving force from the source can be transmitted through a first clutch to the maintenance mechanism. The head can be carried by a carriage perpendicularly to the direction in which the medium is conveyed. When the carriage moves toward or away from the maintenance mechanism, the carriage movement is used by a first clutch switch to render the first clutch operative or inoperative. Ink can be supplied to the head by an ink supply mechanism. The driving force from the source can be transmitted through a second clutch to the supply mechanism. When the carriage moves toward or away from the supply mechanism, the carriage movement is used by a second clutch switch to render the second clutch operative or inoperative.

The single motive power source of this recorder can drive the recording medium conveying roller, the maintenance mechanism and the ink supply mechanism. It is possible to switch the driving force easily and securely through the two clutches and the two clutch switches. Because the carriage movement can operate the switches, there is no need of special devices such as actuators.

This recorder may also include a controller for controlling the motive power source, the recording head and the carriage. When one of the clutches is operative, the controller causes the source to develop driving force.

More specifically, when the carriage enters a maintenance area where the maintenance mechanism is positioned, the first clutch switch may render the first clutch operative, and the controller may cause the motive power source to develop driving force. On the other hand, when the carriage enters an ink supply area where the ink supply mechanism is positioned, the second clutch switch may render the second clutch operative, and the controller may cause the source to develop driving force.

The recorder may further comprise an ink sensor and a maintenance switch. The controller may have a mode in which it controls the maintenance mechanism every time the recorder has carried out print for a predetermined time or when the maintenance switch is pushed manually. The controller may have another mode in which it controls the ink supply mechanism when the ink sensor output a detection signal of ink shortage.

BRIEF DESCRIPTION OF THE DRAWINGS

A preferred embodiment of the invention will be described with reference to the accompanying drawings, in which.

DETAILED DESCRIPTION OF PREFERRED EMBODIMENTS

Figure 1:
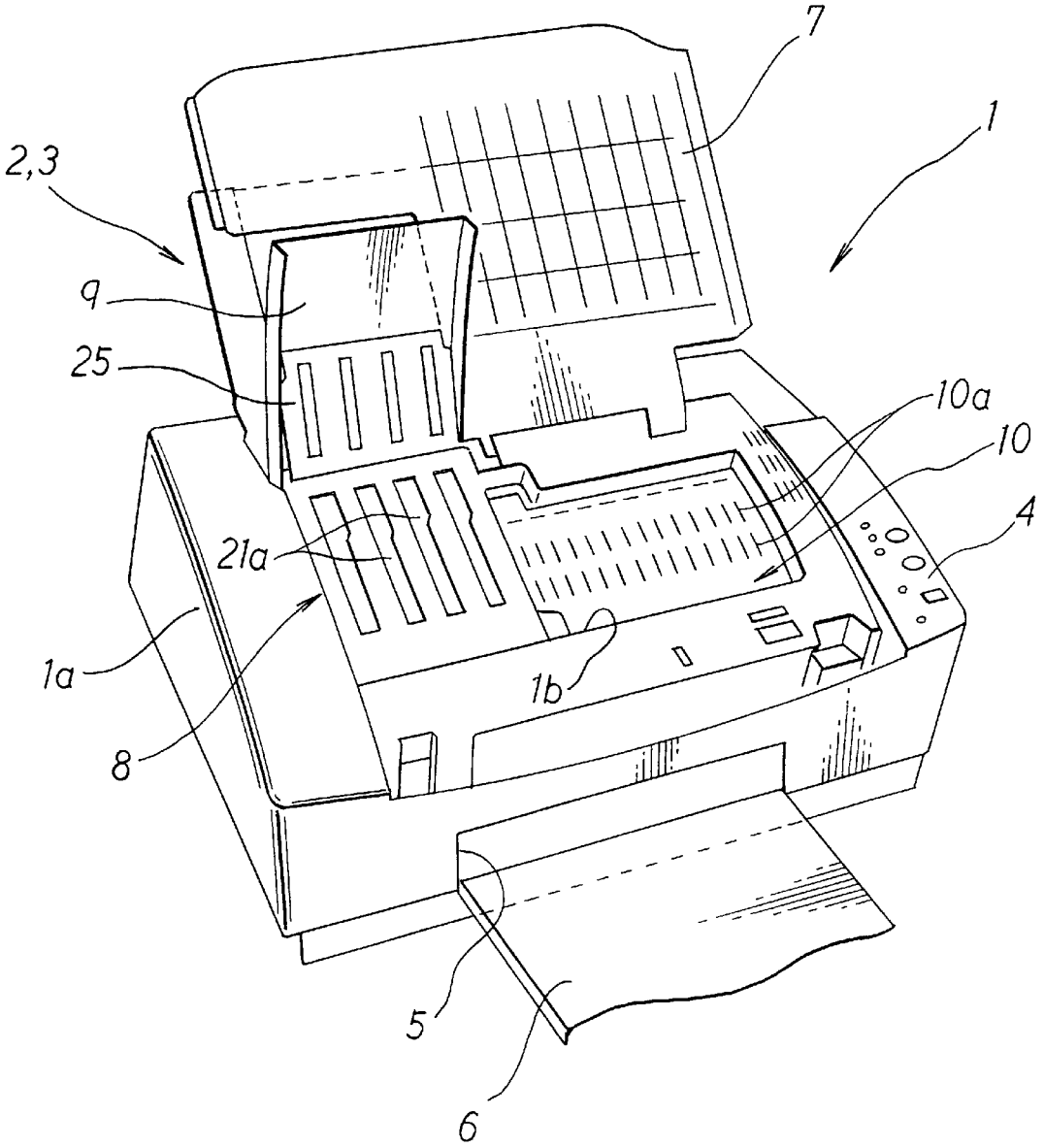
FIG. 1 is a perspective view of a hot melt ink jet printer embodying the invention.
Figure 2:
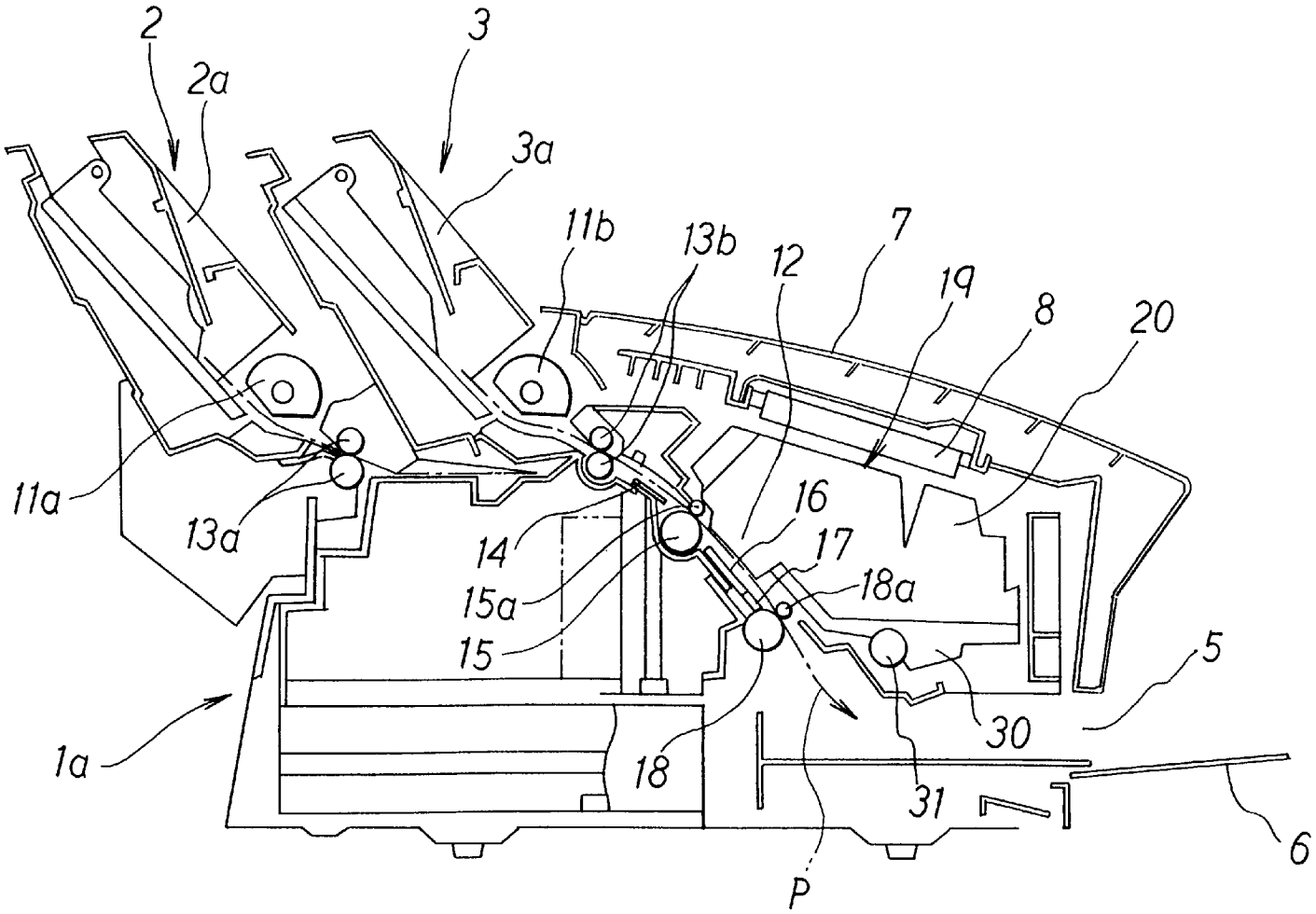
FIG. 2 is a vertical section of the printer shown in FIG. 1.

As shown in FIGS. 1 and 2, a hot melt ink jet printer 1 embodying the invention includes a casing 1*a*. This type of recorder is disclosed in U.S. Pat. No. 5,223,860 and U.S. patent application Ser. No. 08/733,602 filed Oct. 18, 1996 (recently has been allowed) corresponding to Japanese Patent Application LaidOpen No. 9-109380, these disclosures of which are incorporated herein by reference. Two paper feed units 2 and 3 are supported removably by the rear end of the casing top. Cut sheets of paper and transparent paper as recording media can be stacked in the feed units 2 and 3. The transparent paper may be films for overhead projectors. The feed units 2 and 3 include manual paper feed trays 2*a* and 3*a*, respectively, for manually feeding recording media. As shown in. FIG. 1, a control panel 4 is positioned near the left (right in FIG. 1) end of the casing top. The panel 4 has a manual switch for maintenance and other control switches. The front wall of the casing la has a paper discharge port 5, and is fitted with a paper discharge tray 6. A printed medium P can be discharged through the port 5 onto the tray 6.

The top of the casing la has a center opening 1*b*. An ink case 8 is fitted removably in a right (left in FIG. 1) portion of the opening 1*b*. The case 8 houses four rows of yellow (Y), magenta (M), cyan (C) and black (K) ink pellets for color print. The case 8 can be covered with a cover 9, which is supported pivotably by it. The other portion of the opening 1*b* is covered with a transparent cover 10, which is fixed to the casing la. The transparent cover 10 has a number of air outlet holes 10*a*. This cover 10 can be covered with a larger cover 7, which is supported pivotably by the casing 1*a*.

As shown in FIG. 2, semi-cylindrical feed rollers 11*a* and 11*b* are supported at the bottoms of the feed units 2 and 3, respectively. The rollers 11*a* and 11*b* can feed recording media P from the feed units 2 and 3, respectively, to a conveying path. The path includes register rollers 13*a* and 13*b*, a preheat(ing) platen 14, conveying rollers 15, pinch rollers 15*a*, a main platen 16, a cooling platen 17, discharge rollers 18, pinch rollers 18*a*, the discharge port 5 and the discharge tray 6.

Figure 3:
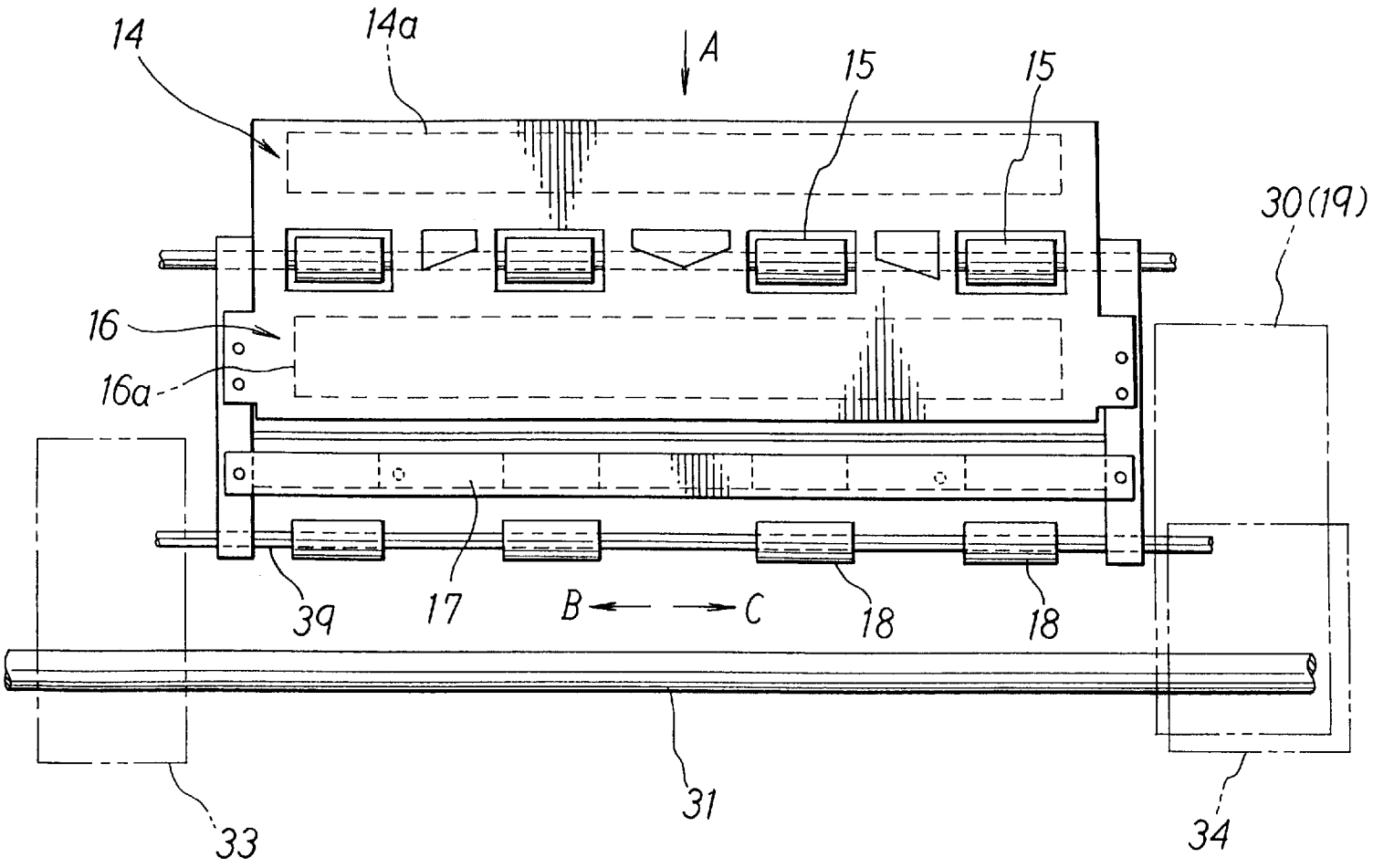
FIG. 3 is a schematic top plan of part of the printer, showing the positional relationship between the carriage, the ink supply mechanism and the maintenance mechanism.

As shown in FIG. 3, the preheat platen 14 and the main platen 16 are fitted with a preheater 14*a* and a main heater 16*a*, respectively, on their back sides. The heaters 14*a* and 16*a* can heat the back side of a recording medium P moving along the conveying path. A recording head unit 19 includes four nozzle heads 12, which are positioned over the main platen 16. Each head 12 has nozzles for ejecting hot melt ink, which sticks to the medium P. By the time the sticking ink reaches the discharge rollers 18, it is cooled by the platen 17 and solidifies. Without the ink transferring to the pinch roller 18*a*, the printed medium P is discharged onto the tray 6.

Figure 4:
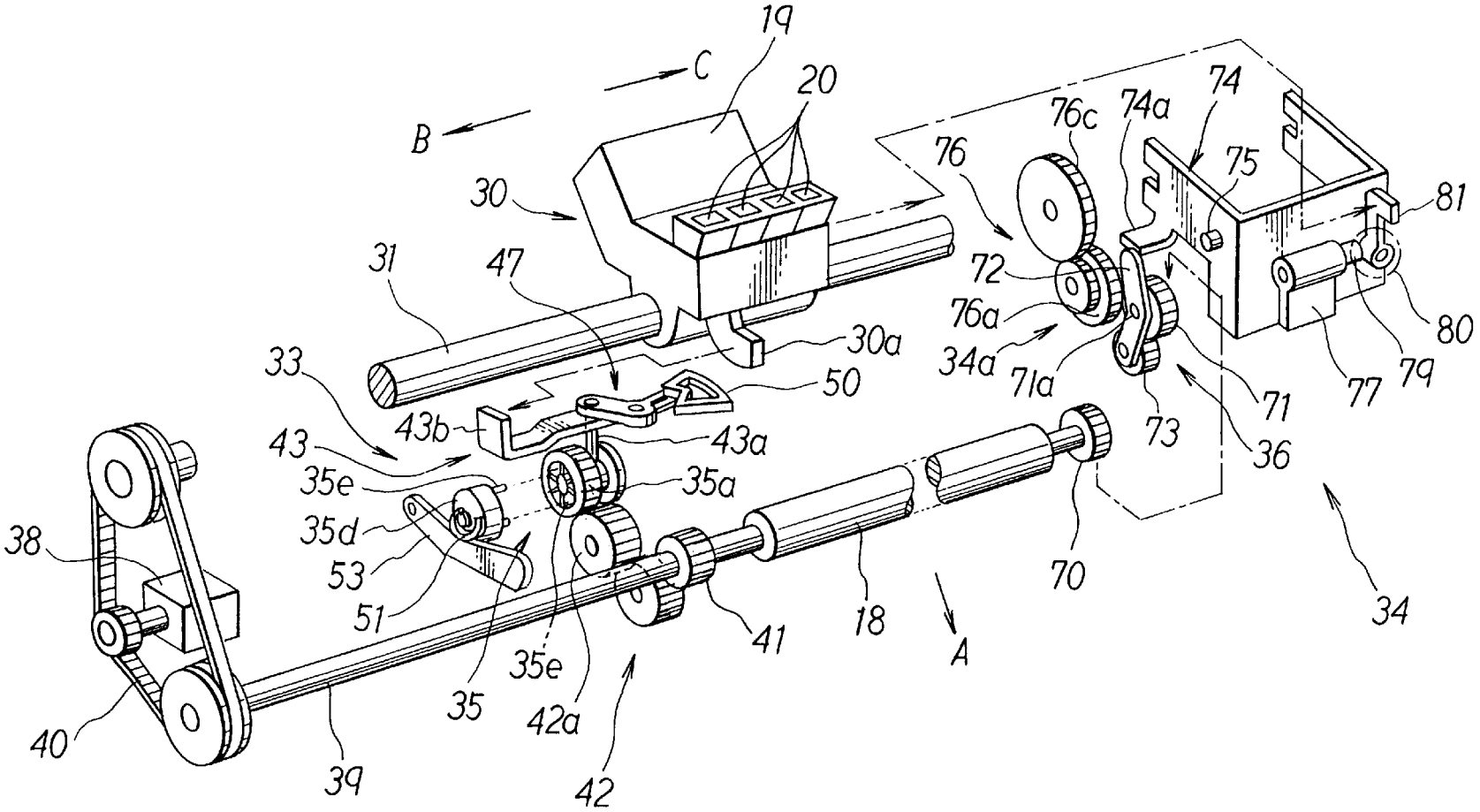
FIG. 4 is a schematic exploded view of part of the printer, showing the carriage, the clutches, etc.

As shown in FIGS. 2 and 4, the recording head unit 19 includes melting hoppers 20 and heaters (not shown). Each hopper 20 is connected to one of the nozzle heads 12, and includes a molten ink tank (not shown) and a heater (not shown). The head unit 19 is mounted on a carriage 30, which is supported on a guide shaft 31 and a guide rail (not shown) slidably along them. The shaft 31 and the rail extend in the primary scanning directions B and C perpendicular to the secondary scanning direction A, in which a recording medium P can be conveyed. The carriage 30 can be reciprocated in the directions B and C by a drive mechanism (not shown) including a carriage motor.

Figure 8:
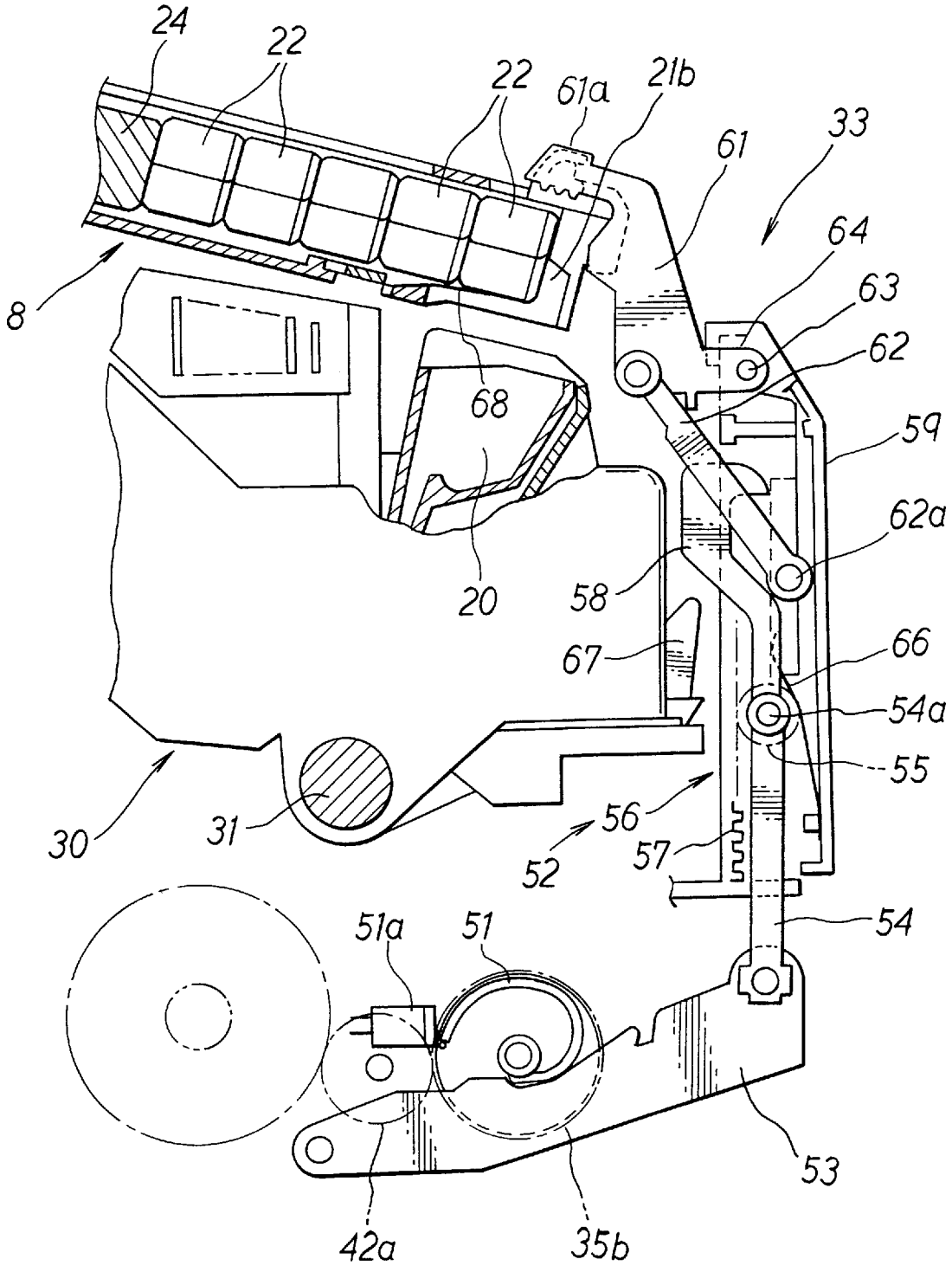
FIG. 8 is a side view partially in vertical section of part of the printer, showing the pellet dropper in one position.

As shown in FIGS. 3 and 8, the printer 1 includes an ink supply mechanism 33 near its right (left in FIG. 3) end. This mechanism 33 can supply the melting hoppers 20 with ink pellets 22 from the ink case 8. As shown in FIG. 3, the printer 1 also includes a maintenance mechanism 34 near its other end. This mechanism 34 can intermittently drive a roll of paper (not shown) for wiping the nozzle surfaces and receiving the ink ejected from the nozzle heads 12.

The term "hot melt ink" generally means the inks which solidify at ordinary temperature and liquefy when heated. This ink may have a softening point between 40 and 140 degrees C. (Centigrade). and a melting point between 50 and 150 degrees C. When the ink is ejected from a nozzle, its viscosity may range between 3 and 50 CPS. It is preferable that the ink be composed of 30–90 wt. % wax, 5–70 wt. % resin, 0.1–10 wt. % color material, and other additives such as a viscosity improver, a surface active agent and a solvent. The ink pellets 22 each have a step on each side so that their upper halves may be wider than the lower halves.

As shown in FIG. 4, a reversible drive motor 38 can rotate the discharge rollers 18 through a timing belt 40 and a rotating shaft 39. The shaft 39 has gears 41 and 70. The motor 38 is a step motor. The maintenance mechanism 34 includes a clutch 36, to which motive power can be transmitted from the gear 70. The ink supply mechanism 33 includes a clutch 35. Motive power can be transmitted from the gear 41 to the upstream side of the clutch 35.

Figure 5:
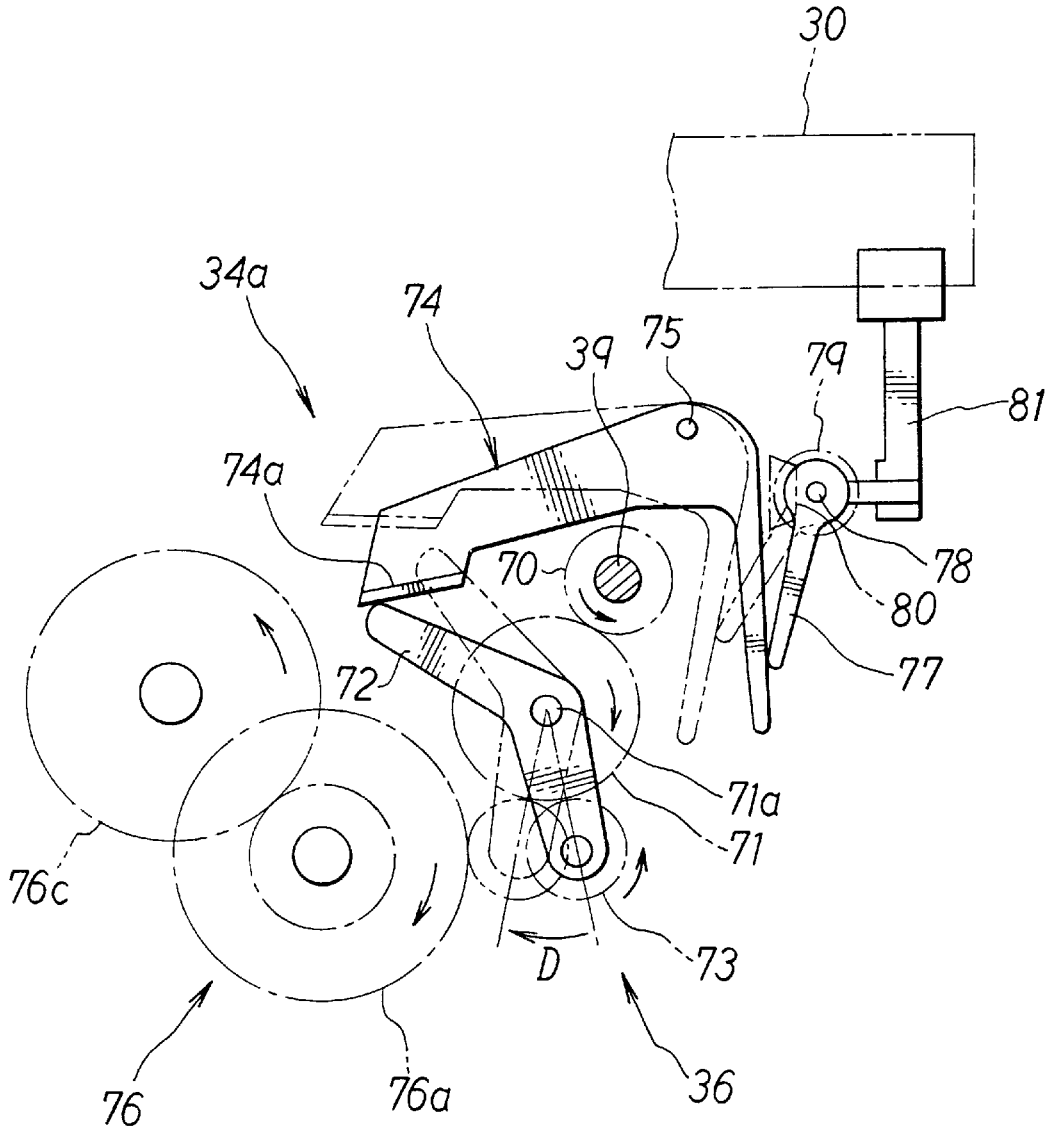
FIG. 5 is a side view of part of the printer, showing the clutch of the maintenance mechanism.

With reference to FIGS. 4 and 5 the movement of the carriage 30 relative to the maintenance mechanism 34 causes a clutch switch (a first clutch switch) to switch the clutch 36 of this mechanism. The clutch 36 includes a planetary gear drive.

The maintenance mechanism 34 includes a transmission 34*a*, which includes a sun gear 71. This gear 71 is in mesh with the gear 70 on the rotating shaft 39. The sun gear 71 is supported on a pin or shaft 71*a*, by which a planet lever 72 is supported rotatably. A planet gear 73 is supported rotatably by one end of the lever 72. The planet gear 73 is in mesh with the sun gear 71 to rotate on its own axis while turning around the gear 71.

The maintenance mechanism 34 includes a pivot member 74 supported pivotably by a pin or shaft 75. This member 74 has a tongue 74*a* for contact with the other end of the lever 72. The member 74 is urged by a spring (not shown) angularly around the pin 75 to turn the lever 72 counter-clockwise in FIG. 5. The maintenance mechanism 34 also includes a driven gear group 76, which includes the first gear 76*a* and the last gear 76*c*. While the pivot member 74 is pushing this and of the lever 72, as shown with solid lines in FIG. 5, the planet gear 73 is kept away from the first driven gear 76*a*. Positioned in front of the pivot member 74 is a lever 77, which is fixed to a rotating shaft 78. One end of this shaft 78 has a bevel gear 79. Another bevel gear 80 is in mesh with the bevel gear 79, and can be turned by an arm 81 for contact with the carriage 30.

When the carriage 30 moves to the right in FIG. 4, its left (right in FIG. 4) side turns the arm 81 clockwise in FIG. 4. This turns the lever 77 clockwise in FIG. 5, turning the pivot member 74 in the same direction against the spring force. The tongue 74*a* of the thus turning pivot member 74 leaves the adjacent end of the lever 72. When the sun gear 71 turns clockwise in FIG. 5, the planet gear 73 meshes with the first driven gear 76*a*. When the motor 38 rotates in the normal direction, turning the sun gear 71 counter-clockwise in FIG. 5, the planet gear 73 leaves the first gear 76*a*. When the planet gear 73 is away from the first gear 76*a*, the planet lever 72 is stopped by a stopper (not shown) from turning further than a predetermined angle.

The last driven gear 76*c* is coupled to a spindle (not shown) for taking up one end of the paper roll for maintenance. When the pivot member 74 is turned to its position shown with two-dot chain lines in FIG. 5, it presses an unwound part of the paper roll on the nozzle heads 12 to wipe the nozzle surfaces.

Every time the printer 1 has carried out print for a predetermined time, or when the maintenance switch is pushed manually, a maintenance process is carried out.

The maintenance process includes moving the carriage 30 to the right in FIG. 4 to turn the pivot member 74 clockwise in FIG. 5. This makes the planet lever 72 free to turn. Then, the motor 38 is rotated reversely by a predetermined number of turns, turning the gear 70 counter-clockwise in FIG. 5 and the sun gear 71 in the opposite direction. This turns the planet gear 73 on its axis counter-clockwise in FIG. 5 and around the sun gear 71 in the opposite direction D. When the planet gear 73 meshes with the first driven gear 76*a*, the torque of the motor 38 is transmitted to the driven gears 76. This takes up a predetermined length of paper from the paper roll after it wipes the nozzle surface. When the motor 38 stops, with a clean unwound part of the paper roll facing the nozzle head, the paper roll take-up ends.

The torque of the driven gears 76 is also transmitted to a purging air pump (not shown). This causes the pump to develop pressure in the nozzle head, ejecting air bubbles and foreign substances in the head together with ink out through the nozzles. The ejected ink is received by an unwound part of the paper roll, and taken away by this part being taken up. This prevents the nozzles from clogging with ink etc.

After the maintenance ends, the carriage 30 is moved toward the print area of the printer 1 (in the direction B in FIG. 4). Then, the carriage 30 leaves the arm 81, allowing the lever 77 and pivot member 74 to return to their original positions. This returns the planet lever 72 to its position shown with solid lines in FIG. 5. This, in turn, moves the planet gear 73 away from the first driven gear 76*a*.

Figure 6:
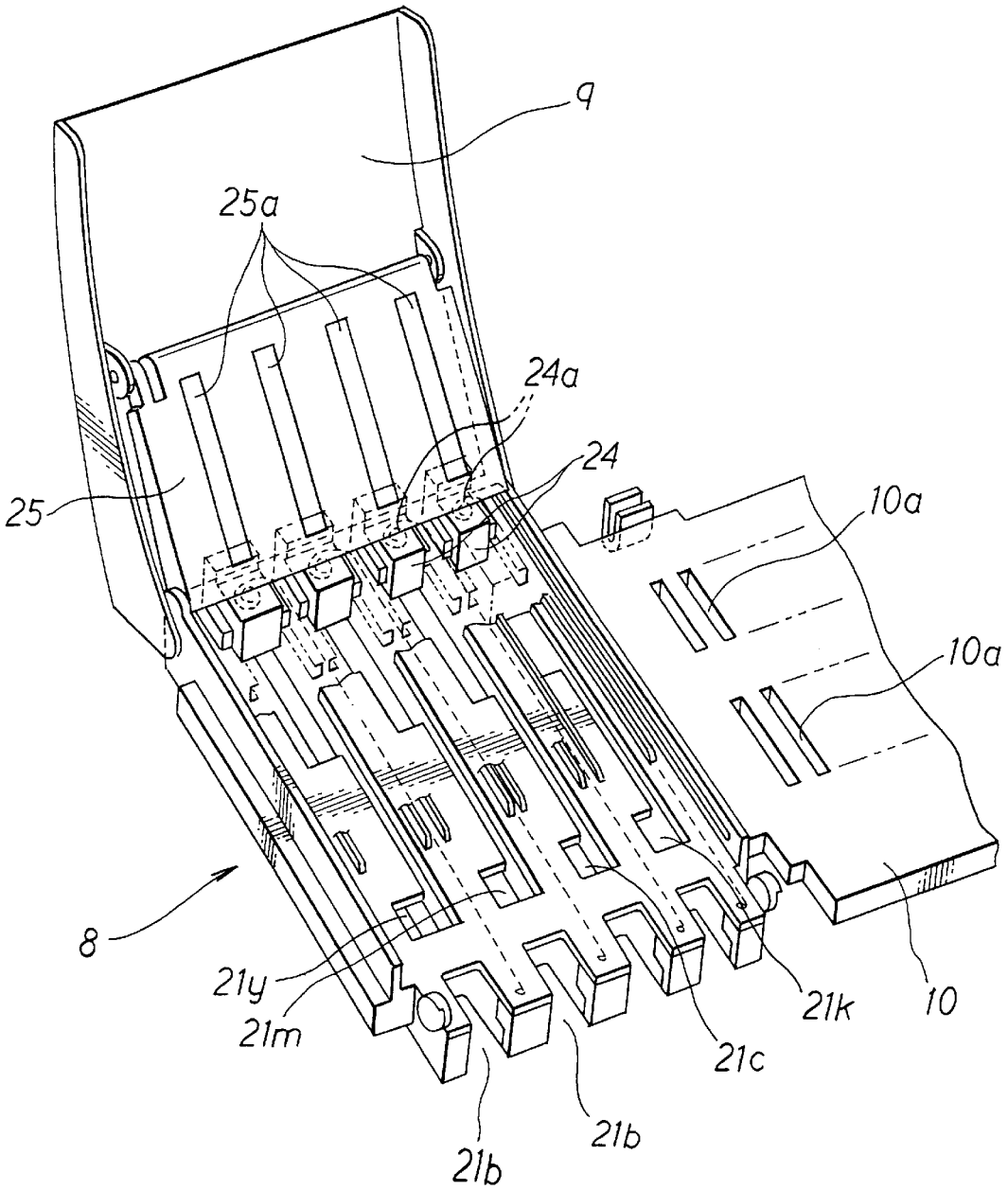
FIG. 6 is a perspective view of the ink case of the printer.

As shown in FIG. 6, the ink case 8 positioned in the ink supply mechanism 33 has grooves 21*y*, 21*m*, 21*c* and 21*k* for yellow, magenta, cyan and black ink pellets 22, respectively. These grooves extend in parallel in the secondary scanning direction A (FIG. 4). The front end of the case 8 has bottom outlets 21*b*, each of which is aligned with one of the grooves 21*y*, 21*m*, 21*c* and 21*k*. Each outlet 21*b* is associated with one of the melting hoppers 20 of the recording head unit 19. As shown in FIG. 8, the case 8 has elastic supporters 68 each extending in one of the outlets 21*b* to support an ink pellet 22 normally.

The bottom of each ink pellet 22 can engage with the associated case groove 21*y*, 21*m*, 21*c* or 21*k* slidably along it. The sidesteps of the pellet 22 can be supported by the banks of the associated groove 21*y*, 21*m*, 21*c* or 21*k*. The bottom of a push block 24 engages with each of the grooves 21*y*, 21*m*, 21*c* and 21*k* slidably along it. The block 24 is urged forward by a spiral spring 24*a* to push the pellets 22 engaging with the associated groove 21*y*, 21*m*, 21*c* or 21*k*. A link 25 is connected pivotably to the case cover 9, and has slots 25*a*. each aligned with one of the grooves 21*y*, 21*m*, 21*c* and 21*k*. A top part of each block 24 engages slidably with the associated slot 25*a*. When the cover 9 opens, the link 25 returns the blocks 24 backward against the force of the springs 24*a*.

The ink supply mechanism 33 can supply ink pellets 22 from the outlets 21*b* of the ink case 8 to the melting hoppers 20. As shown in FIG. 8, the supply mechanism 33 includes a pellet dropper or ejector 52. As shown in FIGS. 4, 7A, 7B and 8, motive power can be transmitted to the dropper 52 through the clutch 35. The torque from the motor 38 can be transmitted through the single rotating shaft 39 to the upstream side of the clutch 35. The movement of the carriage 30 relative to the supply mechanism 33 changes over the clutch 35.

Figure 7A:
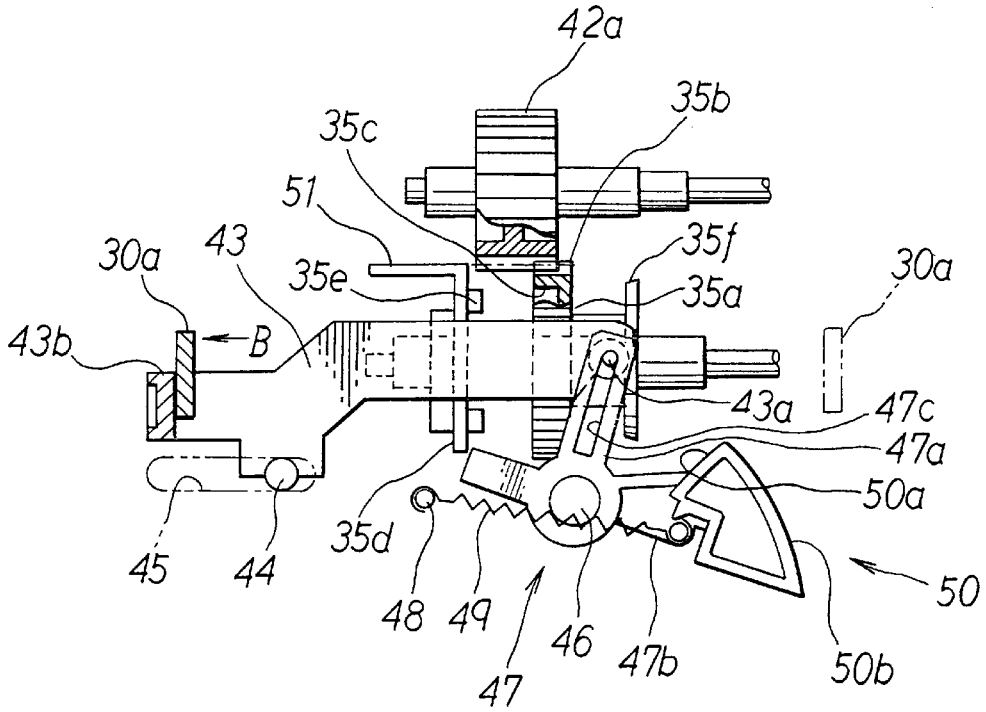
FIGS. 7A and 7B are top plans of part of the printer, showing different positions of the clutch of the ink supply mechanism.
Figure 7B:
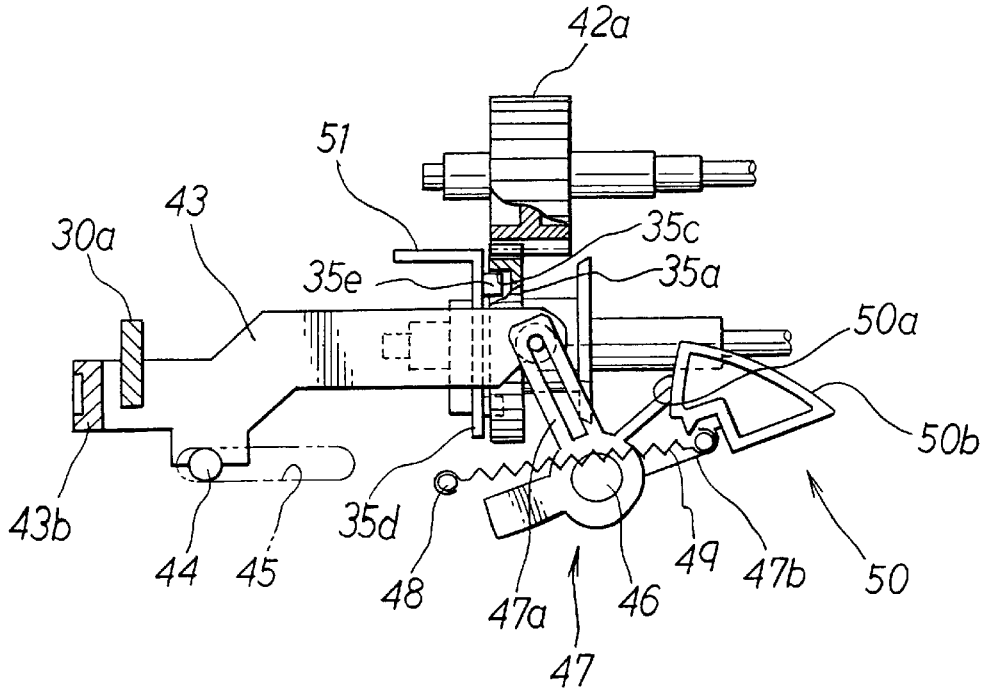

More specifically, as shown in FIGS. 4, 7A and 7B, the clutch 35 includes a driving disc or plate 35*a* and a driven disc or plate 35*d*. The driving disc 35*a* includes a gear 35*b* and a shift ring 35*f*. This gear 35*b* has inner claws or pawls 35*c*. The driven disc 35*d* has claws 35*e* for engaging with the claws 35*c*. The torque from the gear 41 fixed to the rotating shaft 39 can be transmitted to this gear 35*b* through a gear 42*a* of a gear group 42. The gear 42*a* is in mesh with the gear 35*b* of the driving disc 35*a*, which can slide axially.

As shown in FIGS. 7A and 7B, a toggle lever 47 functions as a clutch switch (a second clutch switch), and can turn around a pin 46. The lever 47 includes an arm 47*a* with a slot 47*c*. A shift rod 43*a* engages slidably with the slot 47*c*, and is connected to one end of a shift lever 43. The bottom of the rod 43*a* engages slidably with the shift ring 35*f* of the clutch 35. The shift lever 43 has a pin 44. A frame (not shown) has a guide slot 45 extending in parallel to the guide shaft 31 (FIG. 4). The pin 44 engages slidably with this slot 45. The rod 43*a* can be guided in parallel to the slot 45 by a guide (not shown) so that the shift lever 43 can move below the carriage 30 (FIG. 4) along the guide shaft 31 (in the directions B and C). Therefore, when the toggle lever 47 turns around the pin 46, and when the shift lever 43 moves along the guide slot 45, the driving clutch disc 35*a* moves axially relative to the driven disc 35*d*.

The toggle lever 47 also functions as a means of holding the position of the clutch 35, and includes another arm 47*b*. A tension spring 49 extends between the arm 47*b* and a pin 48, which is fixed to the frame. Depending on where the lever 47 is positioned angularly, it is held in one of two positions by the spring 49.

When the toggle lever 47 is positioned as shown in FIG. 7A, the urging force of the tension spring 49 is positioned on that side of the axis of the pin 46 which is opposite to the lever arm 47*a*. This holds the lever 47 in this position, where the shift rod 43*a* keeps the driving clutch disc 35*a* away and disengaged from the driven disc 35*d*.

When the toggle lever 47 is positioned as shown in FIG. 7B, the urging force of the tension spring 49 is positioned on that side of the axis of the pin 46 which is adjacent to the lever arm 47*a*. This holds the lever 47 in this position, where the shift rod 43*a* keeps the driving clutch disc 35*a* engaging with the driven disc 35*d*.

The carriage 30 has a foot 30*a* formed on its bottom. The shift lever 43 includes an upright part 43*b* formed on its right (left in FIGS. 4, 7A and 7B) end. The arm 47*b* of the toggle lever 47 includes a kicked part 50 formed integrally with it as a means of returning the lever 47. This part 50 has a back face 50*a* and a circular or curved face 50*b*. When the lever 47 is positioned as shown in FIG. 7A, the kicked part 50 is off the locus where the carriage foot 30*a* reciprocates.

When the carriage 30 moves by a predetermined distance in the direction B, its foot 30*a* engages with the upright part 43*b* of the shift lever 43 to move this lever in this direction. This turns the toggle lever 47 counterclockwise in FIGS. 7A and 7B, moving the faces 50*a* and 50*b* of its kicked part 50 into the locus of the foot 30*a*. As shown in FIG. 7B, this also moves the driving clutch disc 35*a* into engagement with the driven disc 35*d*.

When the carriage 30 moves in the direction C, its foot 30*a* kicks the back face 50*a* of the kicked part 50 to turn the toggle lever 47 clockwise in FIGS. 7A and 7B. This returns the lever 47 to the position shown in FIG. 7A, and disengages the driving clutch disc 35*a* from the driven disc 35*d*.

With the carriage foot 30*a* positioned on the left (right in FIGS. 4, 7A and 7B) of the kicked part 50, as shown in FIG. 4, the toggle lever 47 may be turned counter-clockwise in FIGS. 7A and 7B by external force when the printer 1 is delivered from the plant. If the lever 47 is turned in this direction, it is held in the position shown in FIG. 7B, where the shift rod 43*a* holds the clutch 35 operative.

In this case, the curved face 50*b* of the kicked part 50 functions as a returning device for unlocking the clutch 35. This face 50*b* faces the carriage foot 30*a* positioned on the left (right in FIGS. 4, 7A and 73) of the kicked part 50. When the foot 30*a* in this position (two-dot chain lines In FIG. 7A) is moved in the direction B, it slides compressively on the curved face 50*b*. The compressive force of the foot 30*a* on the face 50*b* turns the toggle lever 47 clockwise in FIGS. 7A and 7B. This can return the lever 47 to the position shown in FIG. 7A, where the shift rod 43*a* holds the clutch 35 inoperative.

Figure 12:
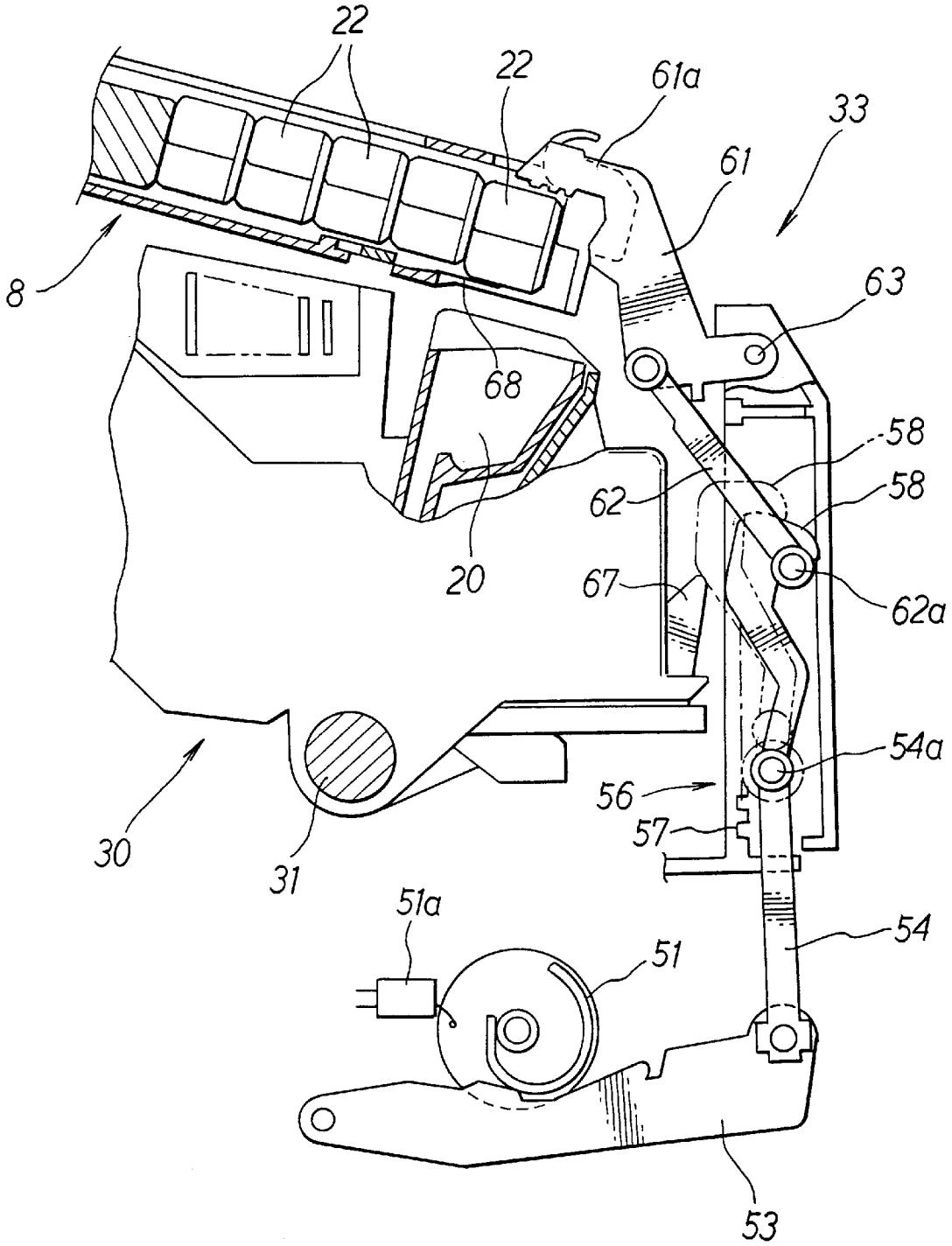
FIG. 12 is another side view partially in vertical section of part of the printer, showing the pellet dropper in another position.

The driven clutch disc 35*d* is connected to a snail cam 51. With reference to FIGS. 8 and 12, when the cam 51 has turned counter-clockwise to its initial or starting position shown in FIG. 8, it turns on a limit switch 51*a* and stops there. With the clutch 35 operative, the reverse rotation of the motor 38 by a predetermined number of pulses turns the cam 51 clockwise by a predetermined angle from the initial position to the position shown in FIG. 12. This angle is smaller than 360 degrees. When the cam 51 turns from the initial position, it turns off the switch 51*a*. Subsequent normal rotation of the motor 38 in the opposite direction by the same number of pulses turns the cam 51 counter-clockwise to the initial position, where the cam 51 turns on the switch 51*a* and stops.

The pellet dropper 52 includes a lever 53. A spring (not shown) urges the free end of the lever 53 upward to bring the lever into contact with the cam 51. The reverse and normal rotations of the motor 38 turn the cam 51 in both directions, causing the lever 53 to pivot between the positions shown in FIGS. 8 and 12.

With reference to FIGS. 8–12, the structure of the ink supply mechanism 33 and the pellet dropper 52 will be described below in more detail.

Figure 10:
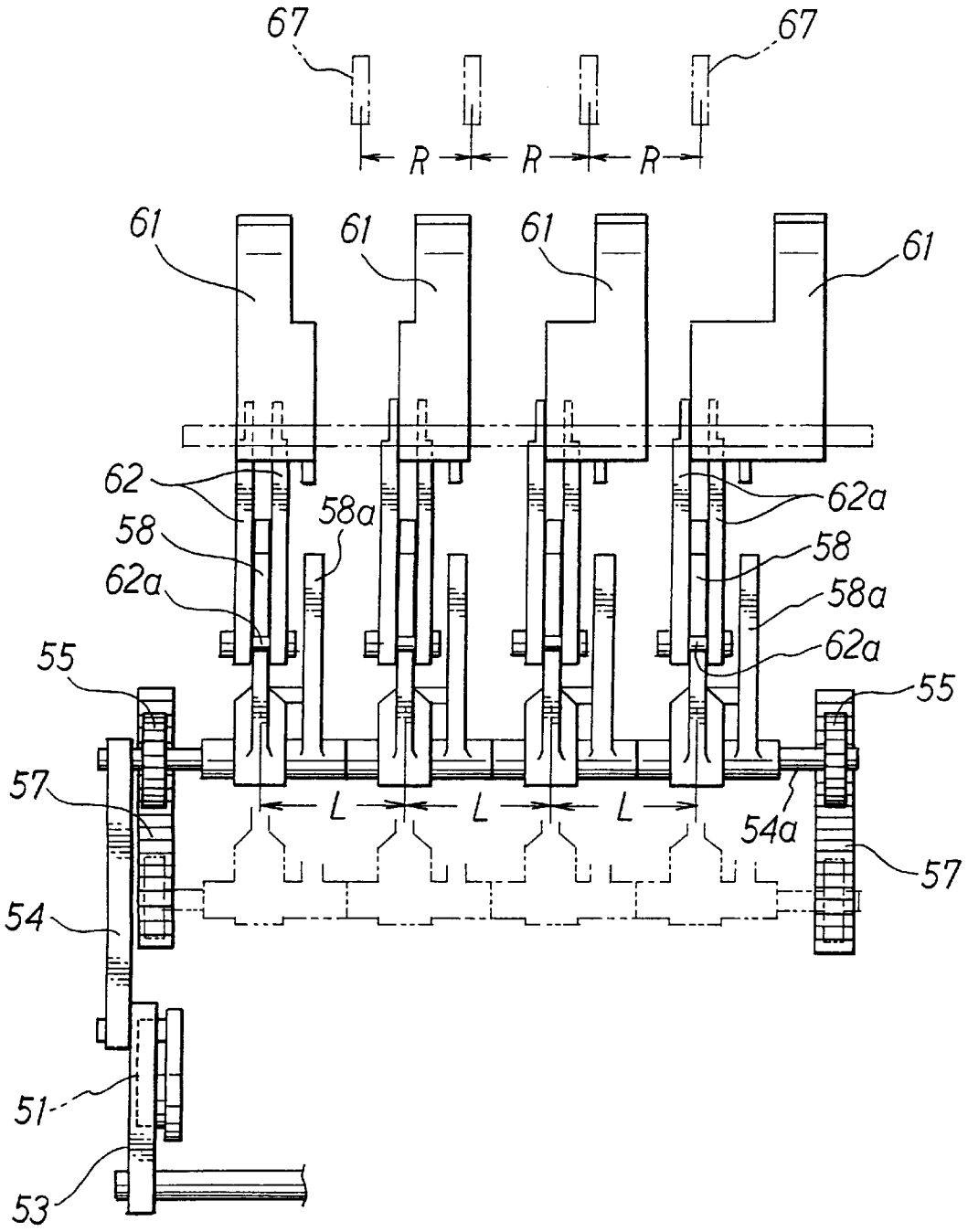
FIG. 10 is a front view of the pellet dropper of the printer.
Figure 11A:
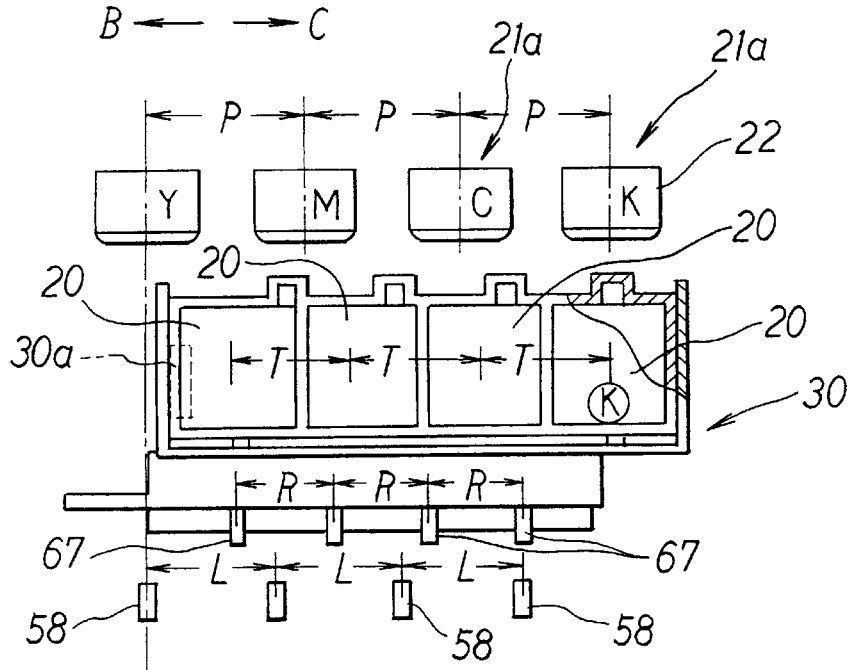
FIGS. 11A, 11B and 11C are top plans of part of the printer, showing different positions of the carriage relative to the ink supply mechanism.

As shown in FIG. 11A, the four outlets 21*b* of the ink case 8 are positioned at regular intervals P. Each outlet 21*b* is aligned with a set of a pusher 61, a link 62 and a hook 58. The four sets of parts are positioned between a vertical frame 56 and a cover frame 59. The pusher 61 can push an ink pellet 22 downward. The link 62 is connected at its top pivotably to the front end of the bottom of the pusher 61, and includes a pair of arms. The bottoms of these arms are connected by a pin 62*a*, with which the hook 58 can engage. The four hooks 58 are supported at their bottoms pivotably on a shaft 54*a*, which is supported rotatably on the top of a connecting arm 54. The arm 54 is supported at its bottom pivotably by the free end of the lever 53. A pair of pinions 55 are supported rotatably on both ends of the shaft 54*a*. The vertical frame 56 has a pair of racks 57 formed on it. The books 58 and the shaft 54*a* are urged toward the vertical frame 56 by a flat spring 66, one end of which is fixed to the cover frame 59. This brings the pinions 55 into mesh with the racks 57. As shown in FIG. 10, the vertical movement of the shaft 54*a* between the frames 56 and 59 moves the hooks 58 together up and down.

Figure 9:
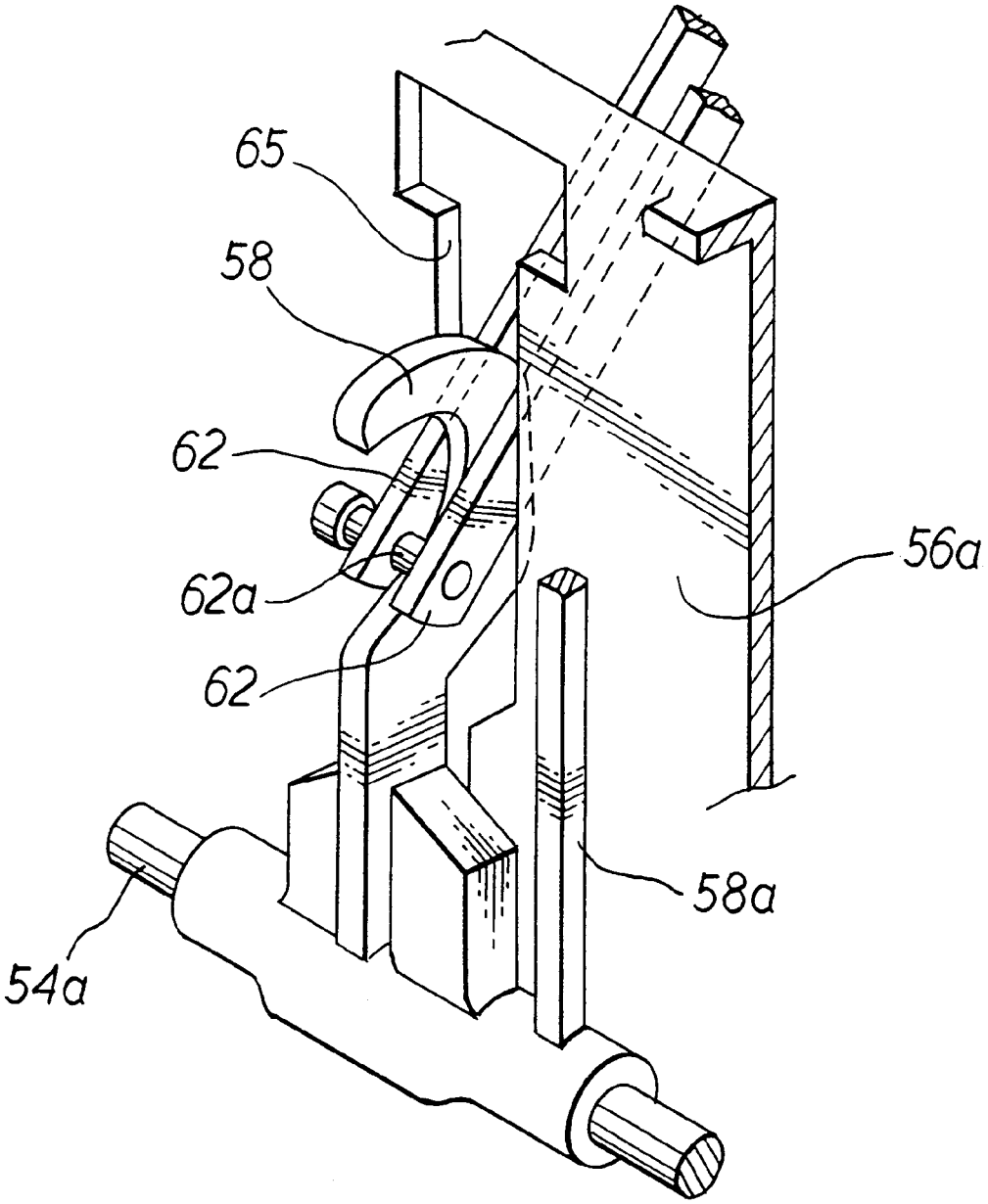
FIG. 9 is a perspective view of part of the printer, showing one of the hooks and the associated link.

The top 64 of the vertical frame 56 supports a shaft 63, on which the pushers 61 are supported pivotably and removably at the rear ends of their bottoms. As shown in FIG. 9, this frame 56 includes a flat plate 56*a* with guide holes 65. A lower portion of each link 62 and the associated hook 58 can move through one of the holes 65. Each hook 58 has a slider 58*a* standing on its bottom. The four sliders 58*a* are in slidable engagement with the frame plate 56*a* to keep the hooks 58 substantially upright.

Figure 11B:
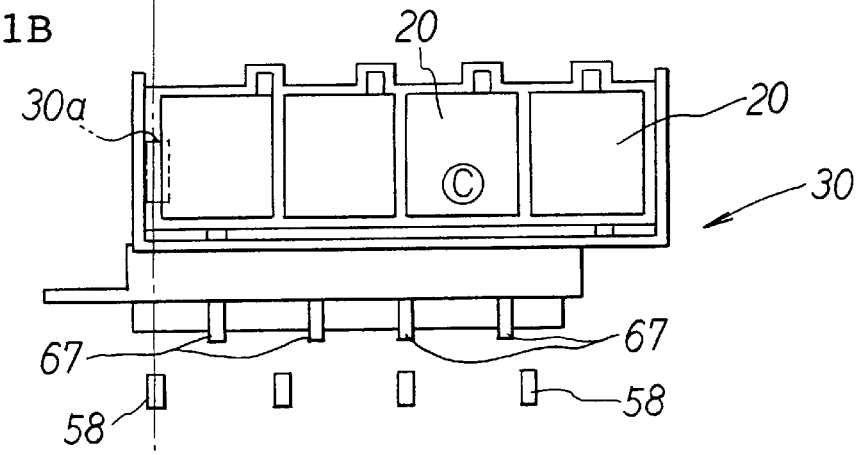
Figure 11C:
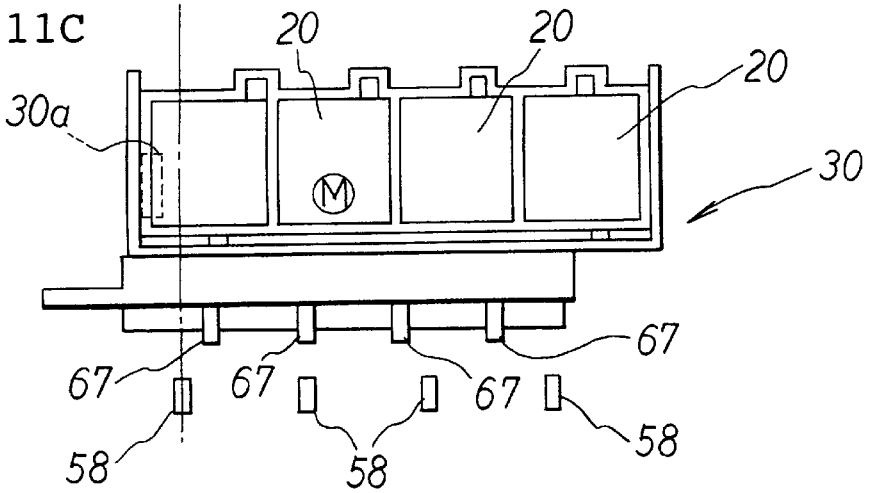

The hooks 58 are positioned at regular intervals L. The carriage 30 includes protrusions 67 positioned on its rear end at regular intervals R. Each protrusion 67 is associated with one of the hooks 58. As shown in FIGS. 11A, 11B and 11C, the intervals R differ from the intervals L in such a manner that, when the carriage 30 stops at a selected position along the guide shaft 31, one of the protrusion 67 is aligned with the associated hook 58 at a time. Therefore, when the hooks 58 move down, one of them can contact the associated protrusion 67 at a time, as shown with the two-dot chain lines in FIG. 12.

With reference to FIG. 12, when one of the hooks 58 moving down contacts and slides on the associated protrusion 67, this hook 58 turns clockwise against the force of the flat spring 66. This engages the hook 58 with the associated pin 62*a*. Further down movement of the hook 58 turns the associated pusher 61 counter-clockwise on the shaft 63. This causes the head 61*a* of the pusher 61 to push the pellet 22 on the associated elastic supporter 68 down toward the associated melting hopper 20. The other hooks 58 move down in a substantially upright position without engaging with the associated pins 62*a*. Consequently, the other pushers 61 do not turn, dropping no pellets 22 through the associated case outlets 21*b*.

When the carriage 30 stops at the position shown in FIG. 11A, its protrusion 67 associated with the case groove 21*k* (FIG. 6) is aligned with the associated hook 58. When the protrusion 67 and hook 58 are aligned, the associated case outlet 21*b* is positioned over the associated melting tank 20. In this case, only a black ink pellet (K) 22 can be dropped into this hopper 20. When the carriage 30 stops at the position shown in FIG. 11B, its protrusion 67 associated with the groove 21*c* is aligned with the associated hook 58. In this case, a cyan ink pellet (C) 22 can be dropped into the associated melting hopper 20. When the carriage 30 stops at the position shown in FIG. 11C, its protrusion 67 associated with the groove 21*m* is aligned with the associated hook 58. In this case, a cyan ink pellet (M) 22 can be dropped into the associated melting hopper 20.

As shown in FIG. 11A, the melting hoppers 20 are positioned at regular intervals T. In order to put wider ink pellets 22 in the ink case 8, it is preferable that the case outlet intervals P be longer than the hook intervals L, and that the intervals L be longer than the carriage protrusion intervals R (P>L>R). The hopper intervals T may be equal to the hook intervals L. In this case, as shown in FIG. 10, the pushers 61 should be shaped differently so that their heads may be dislocated right and left.

Figure 13:
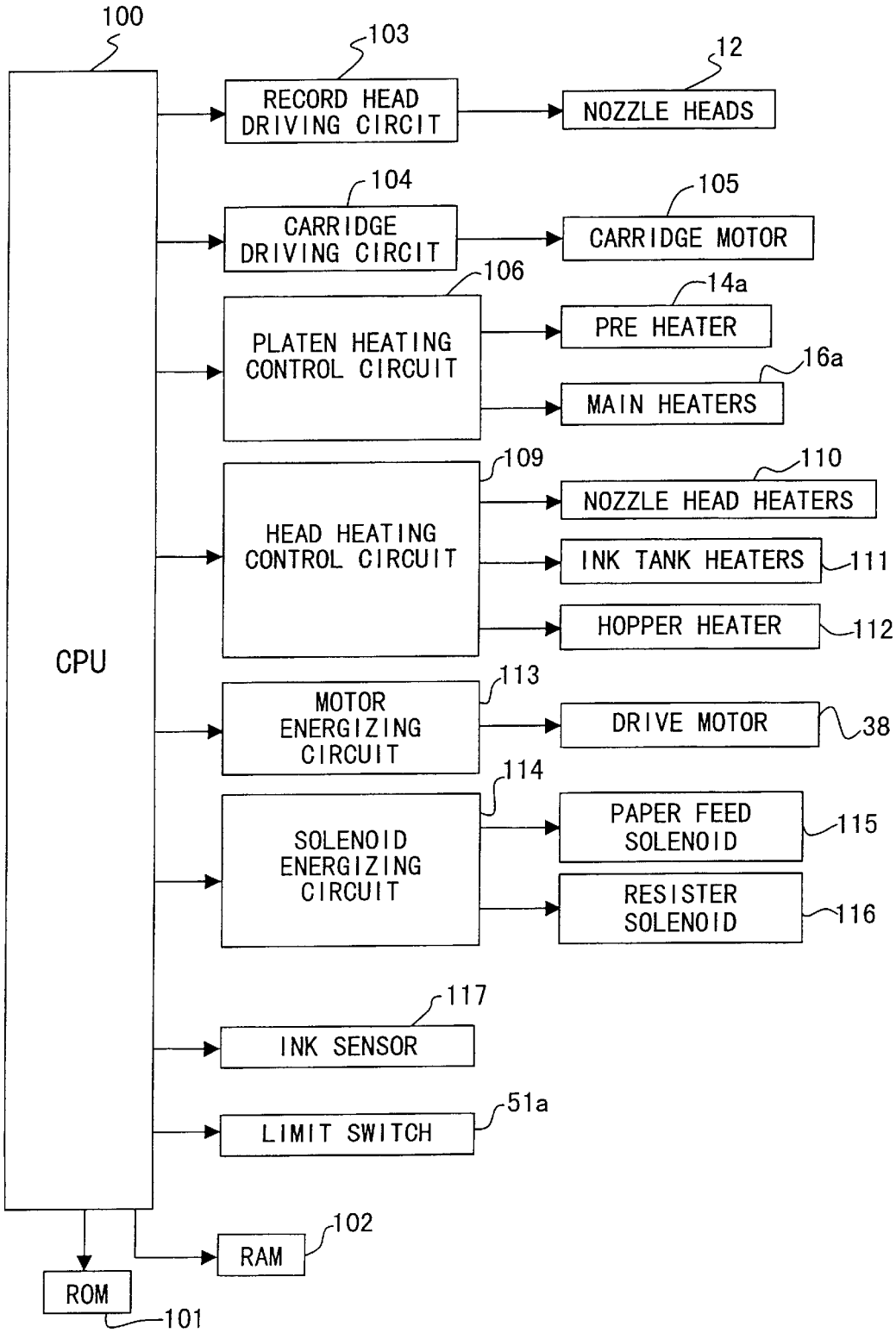
FIG. 13 is a block diagram of the control system of the printer according to the embodiment.

With reference to FIG. 13, the printer 1 includes a control system, which includes a CPU 100, a ROM 101 and a RAM 102. The ROM 101 stores control programs in advance. In accordance with the programs , and on the basis of the print data sent from a host computer (not shown), the CPU 100 carries out operations and control actions necessary for printing color images.

The CPU 100 is connected to:

a head driving circuit 103 for driving the nozzle heads 12 in accordance with the print data;

a carriage driving circuit 104 for energizing the carriage motor 105;

a platen heating control circuit 106 for controlling the energization of the heaters 14*a* and 16*a* to maintain their predetermined temperatures;

a head heating control circuit 109 for controlling the energization of the head heaters 110 for heating the nozzle heads 12, the tank heaters 111 for heating the ink in the molten ink tanks, and the hopper heaters 112 for heating and liquefying the pellets 22 supplied to the melting hoppers 20;

a motor energizing circuit 113 for energizing the drive motor 38; and a solenoid energizing circuit 114 for energizing feed solenoids 115 and register solenoids 116. The feed solenoids 115 can selectively operate either the feed rollers 11*a* or the feed rollers 11*b* to feed a recording medium P to the conveying path. The register solenoids 116 can halt the rotation of the register rollers 13*a* and 13*b* to register a recording medium P.

The CPU 100 is also connected to ink sensors 117 and the limit switch 51*a* so that it may be supplied with detection signals. Each sensor 117 can detect the amount of ink remaining in one of the molten ink tanks.

If one of the ink sensors 117 outputs a detection signal of ink shortage, the CPU 100 transfers to an ink supply mechanism control mode for controlling the ink supply mechanism. In this mode, the CPU 100 outputs predetermined signals to the carriage driving circuit 104 and motor energizing circuit 113 to supply the associated hopper 20 with one of the associated pellets 22. At the same time, the CPU 100 causes the head heating control circuit 109 to energize the heater 112 of this hopper 20 to melt the pellet 22 quickly.

The CPU 100 transfers to a maintenance mechanism control mode for controlling the maintenance mechanism every time the printer 1 has carried out print for a predetermined time or when the maintenance switch is pushed manually. In this mode, the CPU 100 outputs predetermined signals to the carriage driving circuit 104 and motor energizing circuit 113 to perform the maintenance actions as described above.

For normal print, the control of the CPU 100 controls the motor energizing circuit 113 to rotate the drive motor 38 normally. This drives the register rollers 13*a* and 13*b*, the conveying rollers 15 and the discharge rollers 18 to convey a recording medium P. For ink supply, this circuit 113 is controlled to rotate this motor 38 reversely and normally, operating the ink supply mechanism 33. For maintenance of the nozzle heads 12, the circuit 113 is controlled to rotate the motor 38 reversely, operating the maintenance mechanism 34.

The ROM 101 stores programs for the foregoing motor energization control and other control. In order to position the carriage 30 adjacently to the ink supply mechanism 33 or the maintenance mechanism 34, data of carriage position in the primary scanning directions may be necessary. In this case, the data are stored in the ROM 101. For instance, data of carriage position in the primary scanning directions may be calculated or computed with a count of encoder pulses. In accordance with these data, the clutch 35 of the ink supply mechanism 33 can be switched, and ink pellets 22 can be supplied. The data are stored as an encoder count. The RAM 102 can temporarily store the print data from the host computer, and can be used temporarily as a work area for carrying out control actions.

If one of the molten ink tanks is short of hot melt ink, as a result of ink consumption for print, the associated ink sensor 117 detects the shortage. In this case, the carriage 30 moves in the direction B to its left end position in FIG. 7A. The foot 30*a* of the carriage 30 moving in this direction pushes the upright part 43*b* of the shift lever 43 in the same direction. This, as shown in FIG. 7B, turns the toggle lever 47 counter-clockwise. As a result, the clutch 35 is held operative. Then, the carriage 30 is moved in the direction C (FIG. 4) within a predetermined range out of which the carriage foot 30*a* would kick the kicked part 50 and turn the toggle lever 47 clockwise. The carriage 30 is stopped when the melting hopper 20 short of ink is positioned under the associated case outlet 21*b*. At this time, the associated carriage protrusion 67 and dropper hook 58 are aligned. Then, the drive motor 38 is rotated in both directions in order for the lever 53 to pivot up and down once. This drops only one of the associated pellets 22 into the hopper 20.

The clutch 35 of the ink supply mechanism 33 is held operative even if the carriage 30 moves in the direction C (FIG. 11A) to its position shown in FIG. 11A, where a black ink pellet (K) 22 can be supplied to the black ink melting hopper 20.

When no ink pellet is supplied, the carriage 30 can be moved in the direction B within a range where its foot 30*a* does not push the upright part 43*a* of the shift lever 43 (refer to FIG. 7A). The carriage 30 is stopped at the left (FIG. 7A) end of this range to stand by or wait for print. This enables the print stand-by position and the ink supply position to overlap with each other in the primary scanning directions B and C. It is therefore possible to make the printer laterally narrower and more compact.

A transmission mechanism is used through which the normal rotation of the drive motor 38 drives the discharge rollers 18, the feed rollers 11*a* or 11*b*, the register rollers 13*a* or 13*b*, the conveying rollers 15, etc. Therefore, with the carriage 30 stopped at its print standby position (the left side of the print area in FIG. 4), selective operation of the feed rollers 11*a* or 11*b* feeds only one recording medium P from the associated feed unit 2 or 3. Only when the medium P starts to be fed, the associated register rollers 13*a* or 13*b* are halted to register it. Thereafter, the discharge rollers 18 and pinch rollers 18*a* nip and halt the leading end of the medium P being conveyed by the conveying rollers 15.

When print is carried out, as well, the normal rotation of the single drive motor 38 can feed a recording medium P. The normal rotation of the motor 38 drives the discharge rollers 18, which are fixed to the shaft 39, to discharge the medium P. At the same time, the conveying rollers 15 are driven in the same direction as the discharge rollers 18. In this case, with reference to FIG. 5, the reverse rotation of the gear 70 on the shaft 39 turns the sun gear 71 counter-clockwise, as stated above. This moves the planet gear 73 away from the first driven gear 76*a*. Consequently, no unwound part of the paper roll is taken up. In the meantime, as stated above, the clutch 35 of the ink supply mechanism 33 is inoperative. Consequently, no ink pellet is supplied.

The printer 1 may be so adapted that liquid ink can be supplied in place of hot melt ink pellets 22. In such a case, the ink supply mechanism might include ink tanks made of flexible material. The tanks each store liquid ink of one of the four colors, and are positioned at suitable intervals in the primary scanning directions. The supply mechanism might also include pressers positioned at intervals different from the tank intervals. The pressers are each associated with one of the tanks. Each presser can press the associated tank to squeeze or discharge ink from the tank into an ink hopper, which might be mounted on the carriage.

The clutch 35 of the ink supply mechanism 33 might be replaced with a planetary gear type clutch, which includes a sun gear and a planet gear. In such a case, the arrangement shown in FIG. 4 might be laterally symmetric. Then, with reference to FIG. 4, the carriage 30 might be moved to the left. The carriage 30 might be stopped with one of its protrusions 67 aligned with the associated hook 58. Then, the arm 81 might be turned counter-clockwise in FIG. 4, turning the lever 77 clockwise through the bevel gears 80 and 79. This might turn the pivot member 74 in such a direction that its tongue 74*a* might leave the top of the planet lever 72. With reference to FIG. 5, when the sun gear 71 turns clockwise (when the drive motor 38 rotates reversely), the planet gear 73 meshes with the first driven gear 76*a* to transmit motive power. The driven gear 76*a* might drive a shaft which might be fixed to the cam 51.

One turn of the cam 51 causes the lever 53 of the pellet dropper 52 up and down once. When the hooks 58 move down, one of them can engage with the pin 62*a* of the associated link 62. Further down movement of the hook 58 turns the associated pusher 61 around the shaft 63 counter-clockwise in FIGS. 8 and 12. This causes the pusher head 61*a* to push into the associated hopper 20 the pellet 22 supported on the supporter 68 at the associated outlet 21*b*.

This modified embodiment might include no locking mechanisms for the clutches. Therefore, the ink case 8 might store monochrome ink pellets and have one outlet 21*b*.

The normal rotation of the drive motor 38 turns the sun gear 71 counter-clockwise in FIG. 5, moving the planet gear 73 away from the first driven gear 76*a*. With the planet gear 73 away from the driven gear 76*a*, the planet lever 72 might be stopped by a stopper (not shown) from turning further than a predetermined angle in this direction.

What is claimed is:

1. An ink jet recorders comprising:

a recording head for ejecting ink toward a recording medium;

a conveying roller for conveying the recording medium toward the head;

a motive power source for driving the conveying roller;

a maintenance mechanism for keeping in good condition the ejection of ink from the head;

a clutch for transmitting the driving force from the motive power source to the maintenance mechanism;

a carriage for carrying the recording head perpendicularly to the direction in which the recording medium is conveyed; and a clutch switch for rendering the clutch operative or inoperative when the carriage moves toward or away from the maintenance mechanism, wherein the clutch includes:

a sun gear to which the driving force from the motive power source can be transmitted:

a planet arm supported rotatably on the axis of the sun gear:

a planet gear supported rotatably by the arm and meshing with the sun gear; and a driven gear for meshing with the planet gear the driven gear being connected to the maintenance mechanism, the planet gear engaging with the driven gear to transmit the driving force to the maintenance mechanism when the planet arm is at a first angular position and the planet gear disengaging from the driven gear to transmit no driving force to the maintenance mechanism when the planet arm is at a second angular position.

2. The recorder as defined in claim 1, wherein the clutch switch includes a pivot arm for engaging with the planet arm to turn the planet arm.

3. The recorder as defined in claim 2, wherein the clutch switch further includes a turn lever for turning the pivot arm, the carriage turning the lever when the carriage moves toward the maintenance mechanism, whereby the driving force is transmitted to the maintenance mechanism through the swinging of the pivot arm and the turning of the planet arm.

4. The recorder as defined in claim 1, wherein the maintenance mechanism includes:

a roll of paper, on which the recording head can be pressed;

a take-up roller for winding an unwound part of the roll; and a take-up gear fitted to the take-up roller for driving the take-up roller, the take-up gear meshing with the driven gear of the clutch.

5. The recorder as defined in claim 4, wherein the maintenance mechanism further includes an air pump for purging the recording head by being driven with the driving force transmitted from the driven gear.

6. The recorder as defined in claim 1, and further comprising a power transmission mechanism for using the driving force to drive another than the conveying roller and the maintenance mechanism.

7. An ink jet recorder, comprising:

a recording head for ejecting ink toward a recording medium;

a conveying roller for conveying the recording medium toward the recording head;

a motive power source for driving the conveying roller;

an ink supply mechanism for supplying ink to the recording head;

a clutch for transmitting the driving force from the source to the ink supply mechanism;

a carriage for carrying the recording head perpendicularly to the direction in which the recording medium is conveyed; and a clutch switch for switching the clutch to be operative or inoperative, wherein the clutch switch switches the clutch to be operative once the carriage has moved to pass over a predetermined point and even when the clutch is operative, the carriage can still move within a certain area to select at least one of the operation modes of the ink supply mechanism.

8. The recorder as defined in claim 7, wherein the clutch includes a driving clutch plate and a driven clutch plate for mutual engagement, the driving plate including a gear formed on the periphery thereof, to which the driving force can be transmitted.

9. The recorder as defined in claim 8, wherein the clutch switch includes a shift rod for forcing the driving clutch plate into engagement with the driven clutch plate.

10. The recorder as defined in claim 9, wherein the clutch switch further includes a shift lever connected to the shift rod, the carriage including a pusher protruding from the back thereof, the pusher engaging with and moving the shift lever when the carriage moves toward the ink supply mechanism, whereby the shift rod engages the driving clutch plate with the driven clutch plate.

11. The recorder as defined in claim 10, wherein the clutch switch further includes a toggle lever connected to the shift rod, the toggle lever being able to turn between a first position where the rod engages the driving clutch plate with the driven clutch plate and a second position where the rod disengages the driving plate from the driven plate.

12. The recorder as defined In claim 11, wherein the toggle lever is urged selectively toward one of the first and second positions.

13. The recorder as defined in claim 12, wherein the toggle lever has a curved surf ace for slidable engagement with the pusher of the carriage, the pusher being able to slide compressively on the surface when the carriage moves toward the ink supply mechanism, whereby the toggle lever can turn to the second position.

14. The recorder as defined in claim 8, wherein the ink supply mechanism includes a cam connected to the driven clutch plate, a turn lever engaging with the cam, and a member connected to the turn lever for forcing out ink.

15. The recorder as defined in claim 7, and further comprising a power transmission mechanism for using the driving force to drive another than the conveying roller and the ink supply mechanism.

16. An ink jet recorder comprising:

at least one recording head for ejecting ink toward a recording medium;

a conveying roller for conveying the recording medium toward the recording head;

a motive power source for driving the conveying roller;

a maintenance mechanism for keeping in good condition the ejection of ink from the recording head;

a first clutch for transmitting the driving force from the motive power source to the maintenance mechanism;

a carriage for carrying the recording head perpendicularly to the direction in which the recording medium is conveyed;

a first clutch switch for switching the first clutch to be operative or inoperative;

an ink supply mechanism for supplying ink to the recording head;

a second clutch for transmitting the driving force from the motive power source to the supply mechanism; and a second clutch switch for switching the second clutch to be operative or inoperative, wherein the first and second clutch switches switch the clutch to be operative once the carriage has moved to pass over first and second points respectively and even when one of the first and second clutches is operative, the carriage can still move within a certain area to select at least one of the operation of the maintenance mechanism and the ink supply mechanism.

17. The recorder as defined in claim 16, and further comprising:

a controller for controlling the motive power source, the recording head and the carriage;

the controller causing the source to develop driving force when one of the clutches is operative.

18. The recorder as defined in claim 17, wherein the controller enables the carriage to move to a position for replacement of ink.

19. The recorder as defined in claim 17, wherein the first clutch switch renders the first clutch operative and the controller causes the motive power source to develop driving force when the carriage enters an area where the maintenance mechanism is positioned, the second clutch switch renders the second clutch operative and the controller causes the motive power source to develop driving force when the carriage enters an area where the ink supply mechanism is positioned.

20. The recorder as defined in claim 17, further comprising an ink sensor and a maintenance switch wherein the controller transfers to a maintenance mechanism control mode every time the recorder is carried out print for a predetermined time or when the maintenance switch is pushed manually, and the controller transfers to an ink supply mechanism control mode when the ink sensor outputs a detection signal of ink shortage.

21. The recorder as defined in claim 16, the recorder being an ink jet printer for use with hot melt ink.

22. The ink jet recorder according to claim 16, wherein when the second clutch is operative, the carriage can still move within the certain area to select one of operation modes of the ink supply mechanism.

23. The ink jet recorder according to claim 22, wherein the recording head has a plurality of ink heads, and when the second clutch is operative, the carriage can still move within the certain area to select one ink head of the ink heads so as to allow the ink head to perform a predetermined operation.

24. The ink jet recorder according to claim 23, wherein the predetermined operation is to supply an ink pellet to the ink head.

* * * * *